US006585061B2

(12) United States Patent
Radzinski et al.

(10) Patent No.: US 6,585,061 B2
(45) Date of Patent: Jul. 1, 2003

(54) CALCULATING DIRECTIONAL DRILLING TOOL FACE OFFSETS

(75) Inventors: Paul E. Radzinski, Spring, TX (US); Michael L. Larronde, Houston, TX (US); Jian-Qun Wu, Houston, TX (US)

(73) Assignee: Precision Drilling Technology Services Group, Inc., Calgary (CA)

( * ) Notice: Subject to any disclaimer, the term of this patent is extended or adjusted under 35 U.S.C. 154(b) by 0 days.

(21) Appl. No.: 09/976,129

(22) Filed: Oct. 15, 2001

(65) Prior Publication Data

US 2003/0070844 A1 Apr. 17, 2003

(51) Int. Cl.[7] ..... E21B 47/09; G01B 5/24

(52) U.S. Cl. ..... 175/45; 175/61; 73/1.79; 73/866.5

(58) Field of Search ..... 175/61, 45, 328, 175/77; 166/255.1, 255.2, 381, 117.5, 113, 241.1, 241.6; 73/152.46, 1.88, 866.5, 1.79

(56) References Cited

U.S. PATENT DOCUMENTS

| | | | | | |
|---|---|---|---|---|---|
| 4,181,014 | A | * | 1/1980 | Zuvela et al. | 340/853.5 |
| 4,452,075 | A | * | 6/1984 | Bockhorst et al. | 73/152.46 |
| 4,577,701 | A | * | 3/1986 | Dellinger et al. | 175/61 |
| 4,909,336 | A | * | 3/1990 | Brown et al. | 175/45 |
| 5,230,387 | A | * | 7/1993 | Waters et al. | 175/45 |
| 5,248,938 | A | | 9/1993 | Kobayashi et al. | |
| 5,276,631 | A | * | 1/1994 | Popovic et al. | 702/104 |
| 5,311,952 | A | * | 5/1994 | Eddison et al. | 175/61 |
| 5,343,152 | A | * | 8/1994 | Kuckes | 324/346 |
| 6,192,748 | B1 | * | 2/2001 | Miller | 73/152.01 |
| 2002/0185315 | A1 | * | 12/2002 | McLoughlin et al. | 175/76 |
| 2003/0037963 | A1 | * | 2/2003 | Barr et al. | 175/40 |

FOREIGN PATENT DOCUMENTS

| | | |
|---|---|---|
| EP | 0787886 A2 | 8/1997 |
| EP | 0787886 A3 | 8/2000 |
| GB | 2 246 151 A | 1/1992 |
| GB | 2 284 837 A | 6/1995 |

OTHER PUBLICATIONS

The Patent Office, Patents Act 1977 Search Report Under Section 17, Dec. 20, 2002, United Kingdom (one page).

* cited by examiner

*Primary Examiner*—David Bagnell
*Assistant Examiner*—Daniel P Stephenson
(74) *Attorney, Agent, or Firm*—Mark A. Oathout

(57) ABSTRACT

A drilling tool has a bent sub or a defined "High Side". An instrument housing which includes a magnetometer is secured to the directional drilling tool. The magnetometer measures the magnetic field vector in the plane perpendicular to the tool axis. Prior to running the directional drilling tool and the instrument housing into the well, a magnetic source is positioned next to the instrument housing at a position near the magnetometer. The magnetic source is made and positioned such that its magnetic field at the magnetometer points to the chalk line of the high side of a bent sub. The net magnetic field generated from the source is obtained by the difference in magnetic field measurements before and while the magnetic source is applied The azimuthal angle between the net magnetic field vector and the x-axis of the magnetometer or other direction sensor reference point used for tool face calculation is obtained by a computer. This angle is the angular difference or offset angle between the sensor tool face and the high side of the bent sub (as mimicked by the magnetic source). This offset angle is recorded as a signed (±) number and is added to the sensor tool face to produce the bent sub's high side tool face during the drilling operation. No manual measurement of the offset angle and input is required.

20 Claims, 2 Drawing Sheets

CALCULATING DIRECTIONAL DRILLING TOOL FACE OFFSETS

FIELD OF THE INVENTION

This invention relates in general to directional drilling of wells, and in particular to a method and apparatus for more efficient and accurate determination of an angular offset between a directional sensor reference point and the high side of a bent sub.

BACKGROUND OF THE INVENTION

In one method of directional drilling of wells, the drill string includes a rotary drill bit on the lower end connected to a downhole drill motor. The drill motor operates in response to drilling fluid being pumped down the drill string, causing the drill bit to rotate relative to the drill string. Also, the drill string can be rotated along with the drill bit for conventional drilling.

The drill motor assembly includes a bent sub, which is a tubular housing that positions the bit at a slight angular offset, usually about three degrees, from the longitudinal axis of the drill string. As a result, if the drill string is held stationary while the drill motor rotates the drill bit, the bent sub will cause the well to be drilled in the direction of the inclination of the bent sub.

Accordingly, the operator can steer the drill bit in a desired direction if the operator knows the direction of the tool axis (the axial direction of the sensor frame) and the particular orientation of the bent sub about drillstring axis, namely via three parameters, azimuth, inclination and bent sub tool face. Note, for purposes of this discussion, sensor tool face is the same as directional sensor tool face which can be either gravity tool face (sometimes simply called "tool face") or magnetic tool face. Sensor tool face is a measure of the orientational state of the sensor about the tool axis. The bent sub tool face is a measure of the orientational state of the bent sub about the tool axis.

Downhole directional instruments (or sensors) including magnetometers and accelerometers (inclinometers) provide the azimuth, the inclination and the directional sensor tool face. Typically, three magnetometers and three accelerometers are used to measure the three components of the gravity vector and the Earth magnetic field vector in the sensor frame, respectively. For convenience, the magnetometer and accelerometer axes are aligned. Usually, the angle between the sensor x-axis (x and y are perpendicular to the tool axis and to each other) and a geometrical direction is defined as the sensor tool face. For example, in a horizontal well when the x-axis of the directional sensor frame is vertical, the sensor tool face is defined as an angle of zero. In directional wells, the gravity tool face is defined as the angle between the x-axis and the line intersect between the x-y plane and the vertical plane parallel to the tool axis.

In vertical wells, the gravity tool face is not well defined as the x-axis is approximately in the horizontal plane. In this case, one uses the magnetic tool face to indicate the tool orientation about the tool axis. The magnetic tool face is usually defined as the relative angle between the x-axis and the line intersect between the x-y plane and the vertical plane parallel to the magnetic north vector. Under any situation (vertical, horizontal or deviated well) a tool face measurement is available, indicating the tool's orientation about the tool axis.

The directional information,, inclination, azimuth, and tool face, sensed by the downhole instruments will be transmitted to the surface, preferably by using a measurement while drilling ("MWD") telemetry system. The system receives the digital signal from the downhole instruments and operates a poppet valve to provide pulses in the drilling fluid inside the drill pipe. These pulses are detected at the surface and decoded into a readout that informs the operator of the tool's direction.

When the operator is drilling straight, the drill string is rotated along with the drill bit. This makes the borehole slightly larger in diameter than the drill string. When the operator desires to make a turn, he will cease rotating the drill string, and will position it in a desired orientation (e.g. he/she will position the high side of the bent sub in the direction he/she wants to turn). The drilling fluid pumped through the drill string causes the drill bit to rotate. This causes the drill bit to move in the desired direction.

As mentioned, in order to accomplish the directional drilling task, the operator needs to know the orientation of the bent sub. The relationship between the directional sensor sonde and the bent sub is fixed for each bottom hole assembly. From the directional sensor measurement, the directional sensor tool face is known. If the angular difference between the directional sensor reference point and the bent sub is measured on the surface, then the operator can use this measurement and the directional sensor tool face reading to determine the orientation of the bent sub, namely, the bent sub tool face. Such angular difference is sometimes called tool face offset.

In the prior art, the angular difference is determined by the use of a scribe line on the exterior of the instrument housing. The scribe line indicates the direction of the x-axis of the directional sensor frame At the well site, the downhole assembly is assembled and suspended vertically in the derrick. Next an operator draws a visible indicator or vertical chalk line from the high side of the bent sub, up to the directional sensor housing. The operator then measures the angular difference between the scribe line and the chalk line. The measurement may be made with a protractor. Now, the operator must decide whether to add or subtract this angular difference to the directional sensor tool face for purposes of determining the orientation of the bent sub. Obviously, the decision as to whether to add or subtract the angular difference is critical. Operators are trained to follow a procedure to correctly determine whether the angular difference should be input into the surface computer as a positive or negative number to be added to the tool face reading to obtain the bent sub orientation The disadvantage of this system is that it is subject to operator error. The operator must measure the angle properly and then properly subtract or add the angular difference. However if a mistake is made in the decision as to whether the angular difference is to be added or subtracted (e.g. the proper correction is "plus" sixty degrees and one mistakenly subtracts sixty degrees) serious adverse consequences can result. For example, such a mistake can result in the operator drilling in the wrong direction for a period of time and at a significant expense.

SUMMARY OF THE INVENTION

One object of the invention is to eliminate any error which may be made in measuring and applying the angular difference for purposes of determining the orientation of the bent sub. Another object is to implement equipment for achieving same.

In this invention, it is not necessary to form the prior art scribe line on the instrument housing to indicate the internal reference point of the directional sensor. In fact, the magnetometer and inclinometer can be inserted into the instrument housing with a random orientation. However, a locater must be placed on the instrument housing marking the approximate mid-point of the magnetometer between its upper and lower ends. This may be a circumferential locater groove formed in the instrument housing.

At the well site, the tools are assembled and suspended vertically. A technician draws a chalk line from the high side of the bent sub vertically upward onto the directional instrument housing where the chalk line intersects the circumferential locater groove. The operator connects the magnetometer to the surface instrument panel by using a probe and an electrical lead. The magnetic field $B_{before}$ is measured and recorded. The $B_{before}$ is unlikely to be the unperturbed Earth magnetic field due to the amount of steel in the drilling rig and other magnetic fields present on the rig floor. However, measuring the true Earth magnetic field is not relevant at this point.

The operator then takes a magnetic source and places it adjacent the circumferential groove and in alignment with or in a prescribed fixed relationship with the chalk line. The magnetic field $B_{after}$ is then measured. The difference between $B_{after}$ and $B_{before}$ is $B_{source}$, the magnetic field generated by the source alone. Since the direction of $B_{source}$ is that of the chalk line or is in a known relationship with the chalk line, the direction of $B_{source}$ in the magnetometer sensor frame relative to directional sensor tool face (usually the x-axis direction) is or gives the angular tool face offset. This information is recorded in the directional sensor and/or in the surface computer. This angular offset is used later for determining the orientation of the high side of the bent sub for directional drilling.

If the magnetometer has a very large dynamic range, the operator can use a very strong magnetic source. Then $B_{after}$ is approximately equal to $B_{source}$. The $B_{before}$ measurement is not necessary.

DESCRIPTION OF THE PREFERRED EMBODIMENT

Figure 1:
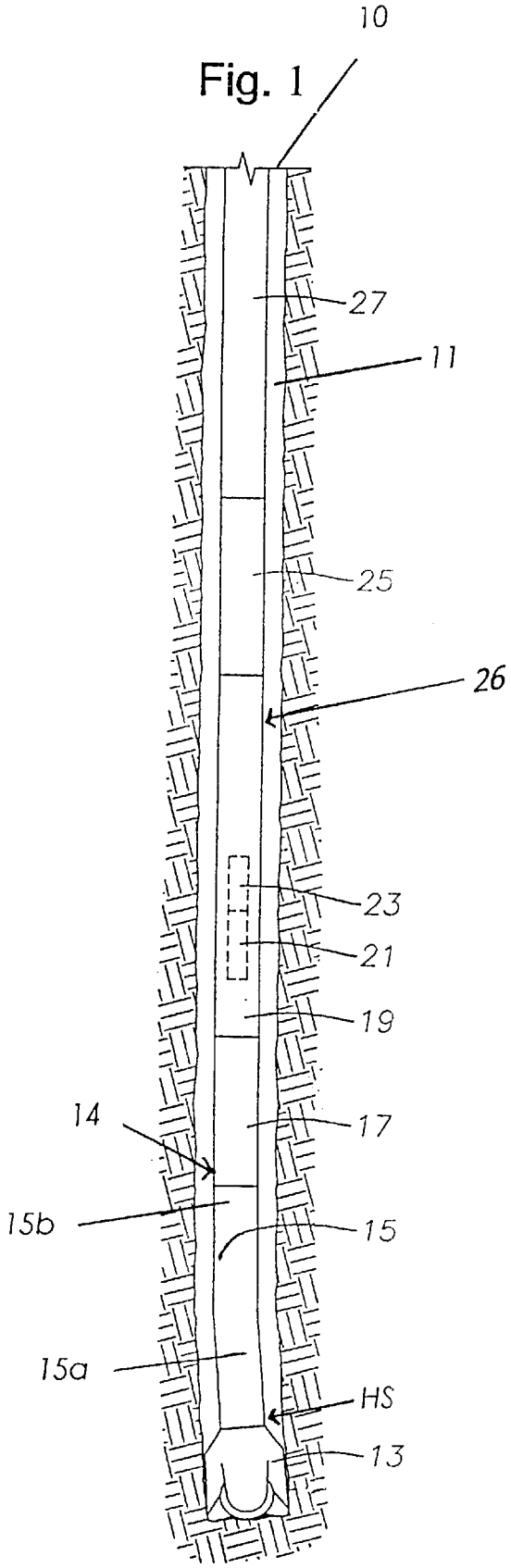
FIG. 1 shows a lower portion of a drill string in a well, the drill string containing directional instruments.

Referring to FIG. 1, a well 11 is shown. The well 11 is drilled by a drill string 27 which includes a rotary drill bit 13. Bit 13 is mounted on the lower end of a directional tool 14, which in this embodiment, includes a bent sub 15. Bent sub 15 is a tubular member which has a lower portion 15*a* inclined about three degrees relative to its upper portion 15*b*. In FIG. 1, the bending of the bent sub 15 is in plane of the paper. The high side (HS) is shown in the figure. The high side HS heads the direction which the drill bit 13 will turn if bent sub 15 is held stationary.

A drill motor 17 is part of the upper portion 15*b* of bent sub 15. A conventional type drill motor 17 typically includes a progressing cavity rotor (not shown) within a stator (not shown). In use, drilling fluid/mud is pumped from the surface 10 through the drill motor 17. This causes a shaft (not shown) to rotate, which rotates drill bit 13 relative to sub 15 if sub 15 is held stationary. The entire drill string 27 can also be rotated to rotate drill bit 13. Note, the invention may incorporate all steerable tools that have a high side (e.g., rotary steerable, jetting, etc.)

An instrument housing 19 is shown mounted above drill motor 17. Instrument housing 19 is a tubular member of non-magnetic material, such as Monel. A number of instruments will be located within instrument housing 19, including one or more magnetometers 21 and an inclinometer 23 (both schematically shown). Magnetometer 21 or the like measures the magnetic field's strength and direction in the magnetometer's sensor frame (shown with dashed line). Inclinometer 23 provides a reading of the amount of tilt of the instrument housing 19 relative to the vertical. Magnetometer 21 and inclinometer 23 may be battery-powered or powered by a generator driven by the flow of the drilling fluid.

Figure 2:
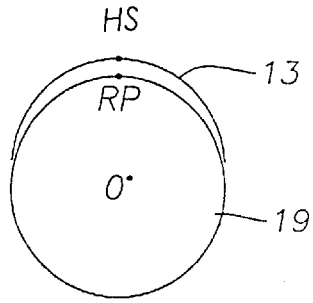
FIG. 2 is a schematic illustration displaying an orientation of directional drilling instruments if the high side of the bent sub and the internal reference point coincide.

Readings of magnetometer 21, and inclinometer 23 are digitized and sent to a pulser 25 for transmission. Pulser 25, normally mounted above instrument housing 19, is of a conventional design. It has a solenoid (not shown) which when actuated by a signal from the electronics will cause a poppet valve (not shown) to actuate. The poppet valve opens and closes a bypass valve (not shown) which creates a pulse in the drilling fluid transmitted back up the inside of the drill string 11 to the surface 10. These pulses are detected by surface instruments (not shown). The surface instruments decode the pulses to provide a surface readout or display in a known manner. Sample portions of such displays are shown schematically in FIGS. 2–4.

As discussed in the Background section of this application, instrument housing 19 secures by threads to drill motor 17 and pulser 25, with the result that the directional sensor reference point RP for tool face (i.e. x-axis) will not normally be oriented so as to coincide with the high side of the bent sub when viewing a cross section through the longitudinal axis of the drill string 27.

Figure 3:
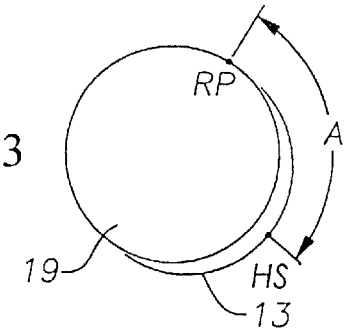
FIG. 3 is a schematic illustration displaying the internal reference point and the high side of the bent sub of the assembly of FIG. 1 misaligned from each other by an offset angle represented by angle A.

In FIG. 3, the high side HS is depicted offset from the directional sensor reference point RP by an angular difference (about 110 degrees in FIG. 3) represented by the angle A. As discussed in the Background section of this application, the operator wants the surface instrument panel to display the direction of the high side, not the direction of the directional sensor reference point RP. Consequently, for a correct reading of the high side HS as depicted in FIG. 3, the operator must add the angle A of about 110 degrees to all directional sensor tool face readings.

Figure 4:
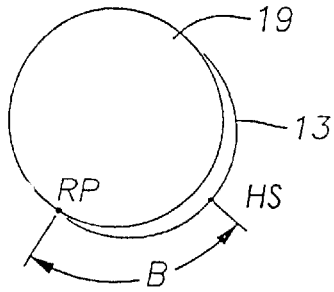
FIG. 4 is a schematic illustration displaying the internal reference point and the high side of the bent sub of the assembly of FIG. 1 misaligned from each other by an offset angle B.

In FIG. 4, the high side HS and directional sensor reference point RP are offset by an angular difference represented by the angle B (about 80 degrees). The operator must subtract the angle B, about 80 degrees, from all the readings in order to have knowledge of the true orientation of high side HS. It is critical to note that in FIG. 3 angle A must be added and in FIG. 4, angle B must be subtracted to obtain the correct surface panel readings of high side tool face from magnetometer 21 and inclinometer 23.

As mentioned in the Background section above, in the prior art, the correction is handled by placing a longitudinal groove or scribe line (both not shown) on the exterior of the instrument housing 19 at the directional sensor reference point RP. While the downhole assembly 26 is hanging in the derrick, an operator will draw a vertical line such as a chalk line 31 from the high side HS of the bent sub upward to the vicinity of the visible scribe line for directional sensor reference point RP. The operator then measures the angle between the visible scribe line and chalk line 31 by a protractor or some other type of device to come up with a measurement for the offset angle, e.g., angle A (FIG. 3) or angle B (FIG. 4). The operator then adds or subtracts the measured angle as the case may be by resetting the surface panel. The ultimate accuracy of the surface panel reading for the position of the bent sub high side HS, in the prior art, depends upon the operator properly measuring the, for example, angles A or B and then properly adding or subtracting such offset angle. Whether to add or subtract depends upon whether the visible scribe line is located clockwise or counterclockwise from the chalk line 31 when measuring from a cross section of instrument housing 19 looking toward the bit 13 and when measuring the offset angle in the direction where the angle will be 180 degrees or less.

Figure 5:
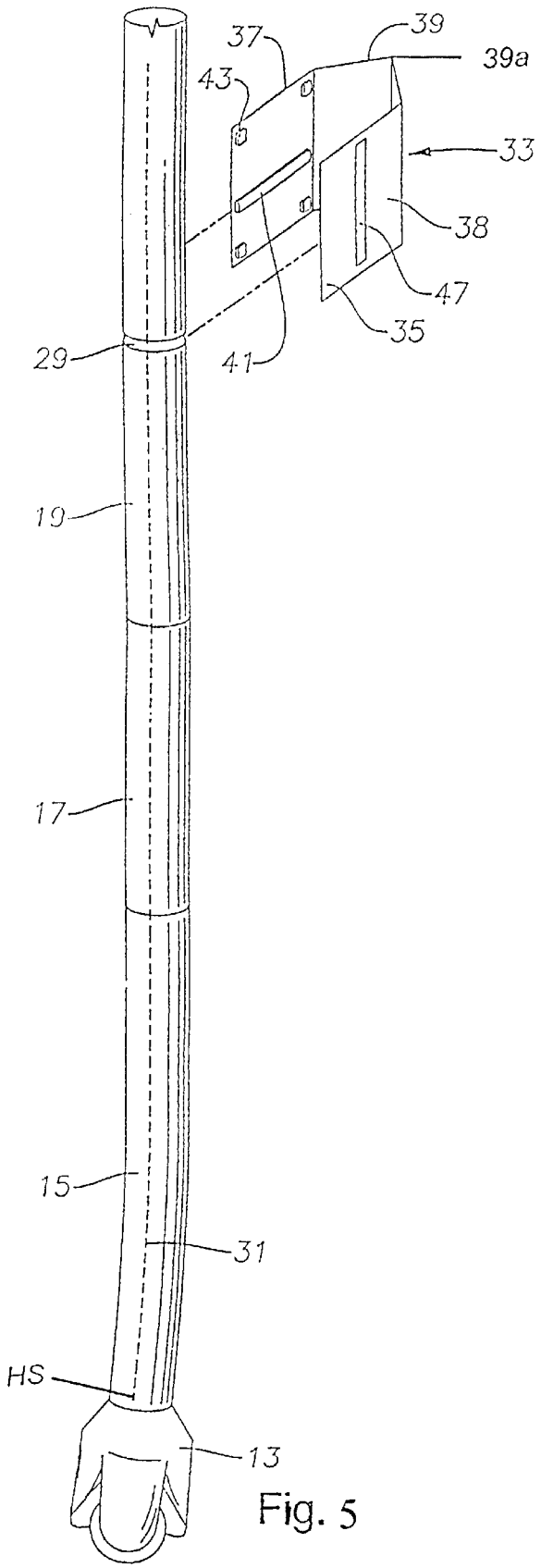
FIG. 5 is a perspective view of a lower portion of the drill string showing a calibrating tool about to be positioned around the instrument housing.

FIG. 5 illustrates the apparatus of the present invention, which removes the need for the operator to physically measure the offset angle A or B. To implement the apparatus, first, a locator 29 is placed on the instrument housing 19 to indicate the general vicinity of magnetometer 21. Preferably, locater 29 is placed approximately where the magnetometers are located, and preferably locater 29 is a circumferential groove formed on the outside of housing 19 although locater 29 may, for example, be an indicator marking, labeling, etc. Normally locater 29 is placed on the instrument housing 19 at a field office or a manufacturing facility. There is no need to place a longitudinal or vertical scribe line to mark the directional sensor reference point RP (or x-axis) as performed in the prior art.

After the downhole assembly 26 of the drill string 27 is assembled and hanging vertically in the derrick, as represented in FIG. 5, the operator draws the indicator chalk line 31, to mark the high side HS, vertically up to locator 29. Next, the operator places a calibrating tool or magnetic source 33 over instrument housing 19 at locator 29. In one embodiment, the magnetic source 33 may be a three part frame 35. Frame 35 includes two side panels 37, 38 which are spaced apart from each other approximately by the width of instrument housing 19. Side panels 37, 38 are parallel to each other and located in different planes in this embodiment. Side panels 37, 38 are connected together by a base 39. Base 39 of this embodiment is V-shaped, having two flat portions which intersect each other at an apex 39*a* which lies equidistant between side panels 37, 38. In other examples, base 39 could be curved, or in a single plane. The frame 35 may have one or two ribs 41 and an alignment slot 47.

Figure 6:
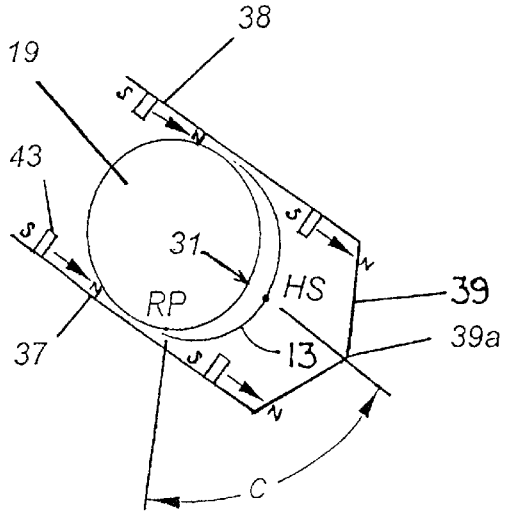
FIG. 6 is a schematic transverse sectional view of the calibrating tool positioned around the instrument housing, wherein the directional sensor reference point is offset from the bent sub high side by an offset angle represented by the angle C.

At least one magnet 43 is mounted to calibrating tool frame 33. Preferably, there are four magnets 43 mounted on each side panel 37, 38. Each magnet 43 is mounted proximate to one of the corners of each of side panels 37, 38. As shown in FIG. 6, magnets 43 are preferably oriented with the north poles all facing in the same direction.

Magnets 43 or their magnetic field must be strong enough to overcome the time-varying magnetic field fluctuations located in the vicinity of the drilling rig (not shown). However, if the magnetic field generated by calibrating tool 33 is too strong it will cause magnetometer 21 to saturate so that it does not give an accurate read of the direction of the magnetic field. A typical magnetometer 21 will saturate at about 1 gauss. Magnets 43 are designed so that they preferably will provide a magnetic induction of 0.25 gauss at magnetometer 21. Generally, the natural magnetism experienced on earth is about 0.5 to 0.7 gauss. Consequently, the magnetic induction of magnets 43 added to the natural magnetism of the earth will be less than the level of saturation.

The operator inserts a probe (not shown) into instrument housing 19 in electrical contact with magnetometer 21. The readings of the three magnetometers, $B_{xbefore}$, $B_{ybefore}$, and $B_{zbefore}$ are taken and recorded in the memory in the sensor and/or in the surface computer.

Then, the operator slides the frame 35 around instrument housing 19 and rotates frame 35 until the apex 39*a* of the base 39 aligns with the chalk line 31 and consequently the high side HS, as indicated in FIG. 6. A technician holds frame 35 in this position, the frame 35 might be temporarily clamped in place or the frame 35 is temporarily fixed in some other manner. Next, three magnetometer readings $B_{xafter}$, $B_{yafter}$, and $B_{zafter}$ are taken and recorded.

The difference between the two magnetic field measurements is the net magnetic field of the magnetic source 33. The x and y components of the field, $B_{xsource}=B_{xafer}-B_{xbefore}$, $B_{ysource}=B_{yafter}-B_{ybefore}$, determine the direction of the net magnetic field component in the x-y plane through the following equation $$\phi=\text{Arctan}(B_{ysource}/B_{xsource})$$

The offset angle $\phi$ is recorded in the sensor or the surface computer. It is added to the sensor tool face to obtain the high side tool face (i.e. the orientation of the bent sub high side), namely $$\text{High side or bent sub tool face}=\text{sensor tool face}+\phi.$$

The offset angle $\phi$ is a signed number. If $\phi$ is positive, the angular difference between the sensor tool face and that of the bent sub high side is added to the sensor tool face. If $\phi$ is negative, the angular difference is subtracted. The above equation accomplishes this automatically.

Since the offset angle $\phi$ is derived from the x and y components of the magnetic field from source 33, the measurement of the z-component is not required for the purpose of determining the tool face offset angle $\phi$. In addition, if the frame 35 is positioned at the midpoint of the magnetometer 21, there should be no z magnetic field component generated from the source 33. The $B_{zsource}$ should be zero. However, measuring the z-component does not practically add any complexity to the hardware, nor increase the operational difficulty. The z-component measurement can be used to monitor how well the frame 35 is positioned.

After completing the calibration procedure, the operator removes magnetic source 33, and the drill string 27 is lowered into the well for drilling. During drilling, all directional sensor reference point RP readouts from inclinometer 23 and magnetometer 21 are automatically compensated in the operational sensor by, in the example of FIG. 6, the subtraction of angle C so that the operator at all times will know which direction the high side of bent sub 15 is oriented. If, for example, the internal reference point RP were located relative to high side HS as in FIG. 3, the angular difference would automatically be added.

The invention has significant advantages. By using the magnetic source 33 and the magnetometer 21, the technician does not have to physically measure an angle and make a determination as to whether it should be added or subtracted. The computation will be automatically processed and displayed with the surface readout. This determination of the offset angle can be handled more quickly than in the prior art and with less chance for error.

While the invention has been shown in only one of its forms, it should be apparent to those skilled in the art that it is not so limited but is susceptible to various changes without departing from the scope of the invention. For example, although magnets are shown on two side panels, it is conceivable that a magnet or magnets on only one side panel would be adequate to provide the desired magnetic field. Also, while the preferred method is to align the chalk line with the apex 39*a* of the base 39, alternately, for example, the midpoint of the side panel 37 or 38 could be aligned with the high side HS and chalk line 31, in which case the magnetic field would be perpendicular to the high side (a different angle would be measured while calibrating, but such could be added or subtracted as necessary to make the angular adjustment). So long as the alignment of the calibrating tool 33 relative to the high side HS is known in advance, the surface software or operational system can make the appropriate corrections.

What is claimed is:

1. A method for directional drilling of a well with a directional tool and a bent sub near a drill bit, comprising:

(a) securing the directional tool having a magnetometer onto a drill string;

(b) positioning a magnetic source adjacent the magnetometer at a pre-selected angular orientation relative to a high side of the bent sub;

(c) measuring magnetic induction using the magnetometer before and after the magnetic source is positioned according to step (b) and recording the magnetic induction readings;

(d) processing the magnetic induction readings obtained in step (C) to determine an offset angle between a directional sensor reference point for the magnetometer and the high side of the bent sub; and (e) adding the offset angle as a signed number to a sensor tool face to obtain a bent sub tool face.

2. The method according to claim 1, wherein step (b) comprises orienting the magnetic source such that a magnetic field vector of the magnetic source at the magnetometer points in a direction of a section line defined from the center of the instrument housing to the line on the instrument housing.

3. The method according to claim 1, wherein step (b) includes placing a line on an instrument housing to mark an orientation of the high side of the bent sub.

4. The method according to claim 1, wherein step (b) includes forming a locater around the reference point and on an instrument housing for the magnetometer.

5. The method according to claim 1, wherein step (b) includes generating a magnetic induction by the magnetic source around the magnetometer having a value less than 0.3 gauss.

6. The method according to claim 1, further comprising moving the magnetic source away from the magnetometer after step (c).

7. The method according to claim 1, wherein step (a) further comprises mounting an inclinometer defining three axes in an instrument housing, coinciding the axes of the inclinometer with three axes defined by the magnetometer, wherein the magnetometer and the inclinometer are mounted in the instrument housing without aligning the directional sensor reference point relative to an orientation of the instrument housing.

8. In a method for determining an offset angle between a directional tool reference point for tool face and a high side of a bent sub, including securing an instrument housing of the directional tool having a magnetometer onto a drill string, the improvement comprising:

(a) placing a locater on the instrument housing to indicate a position of the magnetometer in the instrument housing;

(b) placing a line on the instrument housing to mark an orientation of the high side of the bent sub;

(c) positioning a magnetic source adjacent the magnetometer at a pre-selected angular orientation relative to the line;

(d) measuring a magnetic induction using the magnetometer before and after the magnetic source is positioned according to step (c) and recording the magnetic induction readings;

(e) processing the magnetic induction readings obtained in step (d) to determine the offset angle between the directional tool reference point and the high side of the bent sub; and (f) moving the magnetic source away from the magnetometer; and (g) adding the offset angle as a signed number to a sensor tool face to obtain a bent sub tool face.

9. The method according to claim 8, wherein step (a) comprises forming a marker on an outside of the instrument housing where the magnetometer is located.

10. The method according to claim 8, wherein step (c) comprises orienting the magnetic source such that a magnetic field vector of the magnetic source at the magnetometer points in a direction of a section line defined from the center of the instrument housing to the line on the instrument housing.

11. The method according to claim 10, further including generating a magnetic induction by the magnetic source around the magnetometer having a value less than 0.3 gauss.

12. In a method for determining an offset angle between a directional tool reference point for tool face and a high side of a bent sub for directional drilling of a well including securing an instrument housing of the directional tool having a magnetometer onto a drill string, the improvement comprising:

(a) placing a marker on an outside of the instrument housing to indicate a position where the magnetometer is located;

(b) drawing a line from the bent sub to the marker to mark an orientation of the high side of the bent sub;

(c) positioning a magnetic source adjacent the magnetometer and orienting the magnetic source such that a magnetic field vector at the magnetometer is substantially aligned in a direction of a section line defined from the center of the instrument housing to the line drawn in step (b);

(d) measuring a magnetic induction using the magnetometer before and after the magnetic source is positioned according to step (c) and recording the magnetic induction readings;

(e) processing the magnetic induction readings obtained in step (d) to determine the offset angle between the directional tool reference point and the high side of the bent sub; and (f) adding the offset angle as a signed number to a sensor tool face to obtain a bent sub tool face.

13. The method according to claim 12, wherein step (c) includes mounting a plurality of magnets to two sides of the magnetic source and orienting each of the plurality of magnets with a north pole facing in the same direction.

14. The method according to claim 12, wherein step (c) further comprises sliding the magnetic source into a circumferential groove on the instrument housing.

15. A method for determining an offset angle between a directional sensor reference point for tool face and an orientational reference point including an instrument housing having a magnetometer, comprising:

(a) positioning a magnetic source adjacent the magnetometer at a pre-selected angular orientation relative to the orientational reference point;

(b) measuring a magnetic induction using the magnetometer before and after the magnetic source is positioned according to step (a) and recording the magnetic induction readings; and (c) processing the magnetic induction readings obtained in step (b) to determine an offset angle between the directional sensor reference point and the orientational reference point.

16. The method according to claim 15, wherein step (a) includes placing a line on the instrument housing to mark an orientation of the orientational reference point.

17. The method according to claim 16, wherein step (a) comprises orienting the magnetic source such that a magnetic field vector of the magnetic source at the magnetometer points in a direction of a section line defined from the center of the instrument housing to the line on the instrument housing.

18. The method according to claim 15, wherein step (a) includes forming a locater around the directional sensor reference point and on the instrument housing for the magnetometer.

19. The method according to claim 15, wherein step (a) includes generating a magnetic induction by the magnetic source around the magnetometer having a value less than 0.3 gauss.

20. The method according to claim 15, further comprising moving the magnetic source away from the magnetometer after step (b).

* * * * *